US009359775B2

(12) United States Patent
Thorton

(10) Patent No.: US 9,359,775 B2
(45) Date of Patent: Jun. 7, 2016

(54) SUBSTRUCTURE FOR SUPPORTING A WOOD FLOORING AND FLOORING SYSTEM COMPRISING THE SAME

(75) Inventor: William Thorton, Arlington Heights, IL (US)

(73) Assignee: Tarkett GDL S.A., Lentzweiler (LU)

( * ) Notice: Subject to any disclaimer, the term of this patent is extended or adjusted under 35 U.S.C. 154(b) by 0 days.

(21) Appl. No.: 13/698,479

(22) PCT Filed: Apr. 20, 2011

(86) PCT No.: PCT/EP2011/056377

§ 371 (c)(1),
(2), (4) Date: Jan. 8, 2013

(87) PCT Pub. No.: WO2011/144414

PCT Pub. Date: Nov. 24, 2011

(65) Prior Publication Data

US 2013/0104484 A1 May 2, 2013

Related U.S. Application Data

(60) Provisional application No. 61/345,271, filed on May 17, 2010.

(51) Int. Cl.

| | |
|---|---|
| ***E04B 2/00*** | (2006.01) |
| ***E04B 5/00*** | (2006.01) |
| ***E04B 9/00*** | (2006.01) |
| ***E04F 15/02*** | (2006.01) |
| ***E04F 15/022*** | (2006.01) |
| ***E04F 15/04*** | (2006.01) |

(52) U.S. Cl.

CPC ..... *E04F 15/02177* (2013.01); *E04F 15/022* (2013.01); *E04F 15/02044* (2013.01); *E04F 15/041* (2013.01); *E04F 15/043* (2013.01); *E04F 15/045* (2013.01)

(58) Field of Classification Search

CPC ..... E04F 15/02177; E04F 15/02044; E04F 15/022; E04F 15/225; E04F 15/04; E04F 15/22

USPC ..... 52/177, 403.1, 480, 506.05, 664, 52/745.13, 747.1, 799.12, 666; 404/35, 404/36, 39

See application file for complete search history.

(56) References Cited

U.S. PATENT DOCUMENTS

| | | | | |
|---|---|---|---|---|
| 444,042 | A | 1/1891 | Brock | |
| 1,036,187 | A * | 8/1912 | Cable | 52/180 |

(Continued)

FOREIGN PATENT DOCUMENTS

| | | | |
|---|---|---|---|
| DE | 1036493 | B | 8/1958 |
| DE | 29703319 | U1 | 8/1997 |

(Continued)

*Primary Examiner* — Brian Mattei

(74) *Attorney, Agent, or Firm* — Reinhart Boerner Van Deuren P.C.

(57) ABSTRACT

The present invention relates to a substructure unit (1) for a flooring system (10), said substructure unit (1) comprising a first series (2) of panels (3) arranged in parallel and being fixed under a second series (4) of panels (3) arranged in parallel, said first series and second series (2 and 4) of panels (3) being arranged in a criss-cross manner to form a diagonal lattice, said panels (3) of said first and second series (2, 4) having bevelled cut ends (5, 6) extending outwardly from said lattice to form coupling means to interconnect at least two substructure units (1).

25 Claims, 5 Drawing Sheets

(56) References Cited

U.S. PATENT DOCUMENTS

| | | | | | |
|---|---|---|---|---|---|
| 2,402,090 | A * | 6/1946 | Ruppel | 404/36 |
| 3,554,850 | A * | 1/1971 | Kuhle | 52/392 |
| 4,289,420 | A * | 9/1981 | Davis et al. | 404/35 |
| 4,443,989 | A * | 4/1984 | Silvey et al. | 52/402 |
| 4,462,712 | A * | 7/1984 | Penland, Sr. | 404/36 |
| 4,600,336 | A * | 7/1986 | Waller, Jr. | 404/35 |
| 4,875,800 | A * | 10/1989 | Hicks | 404/35 |
| 5,155,963 | A * | 10/1992 | Woodman | 52/656.8 |
| 5,299,401 | A | 4/1994 | Shelton | |
| 5,526,621 | A * | 6/1996 | Shelton | 52/302.1 |
| 5,540,024 | A | 7/1996 | Stalford | |
| 6,363,675 | B1 * | 4/2002 | Shelton | 52/403.1 |
| 6,557,314 | B2 * | 5/2003 | Shelton | 52/480 |
| 2001/0000557 | A1 * | 5/2001 | Cantley | 52/666 |
| 2002/0189184 | A1 | 12/2002 | Shelton | |
| 2004/0103602 | A1 * | 6/2004 | Geraud | 52/403.1 |
| 2005/0161116 | A1 * | 7/2005 | Chang | 144/346 |
| 2006/0179752 | A1 * | 8/2006 | Swanson et al. | 52/403.1 |
| 2007/0062139 | A1 * | 3/2007 | Jones et al. | 52/403.1 |
| 2009/0152523 | A1 * | 6/2009 | Erwin | 256/24 |
| 2009/0173034 | A1 * | 7/2009 | Woolston | 52/660 |

FOREIGN PATENT DOCUMENTS

| | | | |
|---|---|---|---|
| DE | 102007036267 | A1 | 2/2009 |
| EP | 1 611 930 | A1 | 1/2006 |

* cited by examiner

SUBSTRUCTURE FOR SUPPORTING A WOOD FLOORING AND FLOORING SYSTEM COMPRISING THE SAME

FIELD OF THE INVENTION

The present invention relates to a substructure unit for supporting an upper flooring and to a flooring system comprising such a substructure unit.

PRIOR ART AND RELATED TECHNICAL BACKGROUND

It is well known that grounds are generally covered by synthetic material or by wood inlaid flooring to provide a surface which is more aesthetic and more comfortable.

For sports purposes or other indoor recreational, the flooring has to have suitable properties, as for example rebounding, shock-absorbing, and/or stability properties.

Usually, a wood flooring system comprises a substructure and an upper flooring arranged above and supported by the substructure.

For example, EP1611930 discloses a gymnastics exercise floor comprising a rectangular subfloor provided with panels and a compressible top layer provided on the panels. The panels in the rectangular subfloor are diagonally arranged. The top layer is furthermore arranged in strips on the subfloor oriented parallel, with the strips of the springy top layer including an acute angle with the panels.

U.S. Pat. No. 5,299,401 discloses an athletic flooring system wherein the subfloor is made up of a first and a second wood subfloor wherein the first subfloor is less continuous and more elastic than the second subfloor and wherein the boards of the first and second subfloors cross each other at an angle of 50 degree. The subfloors act in cooperation with a pad and with void volumes distributed in the subfloor to give the flooring system elastic properties.

Among a large number of drawbacks, these known wood floorings substructures are constructed on site leading thus to an increasing labour cost and to an increasing of installation complexity.

US2002189184 discloses a ladder-shaped subassembly for use in assembling a subfloor for an athletic floor that is anchored. Long nailing strips form the long members of the ladder-shape while shorter transverse anchor strips secured below the long members form the rung members of the ladder shape and comprise resilient pads secured to their lower face. This solution presents the drawbacks of having poor dimensional stability.

AIMS OF THE INVENTION

The present invention aims to provide a substructure unit, and a wood flooring system comprising such a substructure unit, that do not have the drawbacks of the prior art.

The present invention aims to provide a substructure unit and a wood flooring system that is an alternative to existing substructures and systems.

The invention aims to provide a substructure unit and a wood flooring system being easy to handle and to install, with a better control of installation.

The invention aims to provide a substructure unit and a wood flooring system having reduced costs of fabrication.

The invention aims to provide a substructure and a wood flooring system having enhanced stability, acoustic reduction, being light in weight.

SUMMARY OF THE INVENTION

The present invention relates to a substructure unit for a flooring system, said substructure unit comprising a first series of panels arranged in parallel and being fixed under a second series of panels arranged in parallel, said first series and second series of panels being arranged in a criss-cross manner to form a diagonal lattice, said panels of said first and second series having bevelled cut ends extending outwardly from said lattice to form coupling means to interconnect at least two substructure units.

According to particular embodiments, the substructure unit may comprise one, or a combination, of any of the following characteristics:

- the panels of the first series are arranged at an angle of about 45 degree in respect to the panels of second series,
- the bevelled cut ends of the panels have an angle of about 45 degree,
- the panels are made of wood,
- the panels of the first series are fastened to the panels of the second series by screws,
- the space between two panels of the first series is higher than the space between two panels of the second series,
- the substructure unit comprises resilient means provided under the panels of the first series of panels,
- the substructure unit is a prefabricated substructure unit.

The present invention relates also to a flooring system comprising at least one substructure unit according to the invention and an upper flooring.

According to particular embodiments, the flooring system may comprise one, or a combination, of any of the following characteristics:

- the upper flooring comprises a plurality of flooring elements laid on the at least substructure unit, fastened together in a parallel pattern and arranged parallel to one of the axis of the quadrilateral formed by the lattice shape of the prefabricated substructure unit,
- the flooring system is a sport flooring.

The present invention relates also to a method to install a flooring system said method comprising the steps of providing at least one substructure unit according to the invention, depositing on the surface to cover at least one barrier layer having vapour barrier properties, depositing on the barrier layer the at least one substructure unit, depositing at least one flooring element of an upper flooring on the at least one substructure unit.

According to particular embodiments, the method according to the invention may comprise one, or a combination, of any of the following characteristics:

- the substructure unit is a prefabricated substructure unit assembled in a remote place from the location of installation of the flooring system,
- the method further comprises the step of assembling resilient means under the panels of the first series of panels of the substructure unit,
- the method further comprises the step of depositing a force reducing cushioned barrier over the surface to cover or over the barrier layer before depositing the at least one substructure unit.

SHORT DESCRIPTION OF THE DRAWINGS

DETAILED DESCRIPTION OF THE INVENTION

Figure 1:
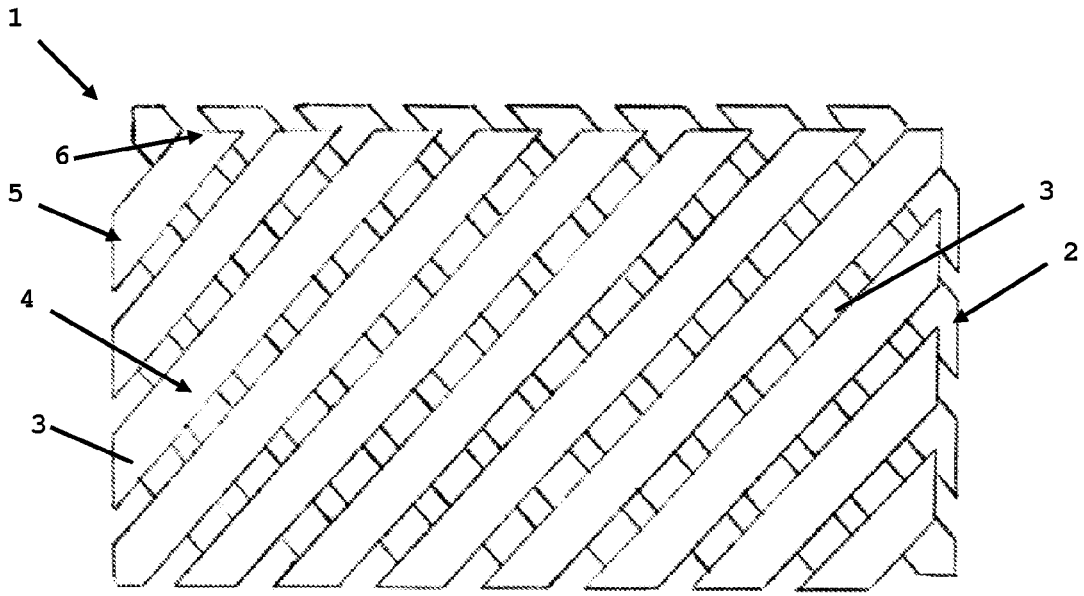
FIG. 1 represents schematically a substructure unit according to the invention.

The substructure unit 1 according to the invention comprises a plurality of parallel panels 3, or laths, arranged in two series. A first series 2 forms a first layer (lower layer) of parallel panels 3 onto which is fixed a second series 4 of parallel panels 3 forming a second layer (upper layer). The two series 2 and 4 of parallel panels 3 are arranged in a criss-cross manner to form an overlapping network or lattice, preferably a diagonal lattice.

The diagonal lattice shape presents the advantage of giving dimensional stability to the substructure unit 1 but also to the flooring system 10 comprising such a substructure unit 1.

Preferably, the panels 3 of the first series 2 are arranged at an angle of around 45 degree in respect to the panels 3 of second series 4. This arrangement further enhances the dimensional stability to the substructure unit 1 and of the flooring system 10.

The panels 3 of the first series 2 and second series 4 comprise two opposite sides and two opposite ends 5 and 6. They are made of wood, preferably softwood, more preferably made of pine, and have any suitable dimension. Preferably, the panels 3 have a thickness comprised between 0.75 inch (1.9 cm) and one inch (2.5 cm) and a width comprised between 5 inches (12.7 cm) and six inches (15.24 cm), their length being comprised between 22 inches (55.9 cm) and 68 inches (172.7 cm).

Figure 2:
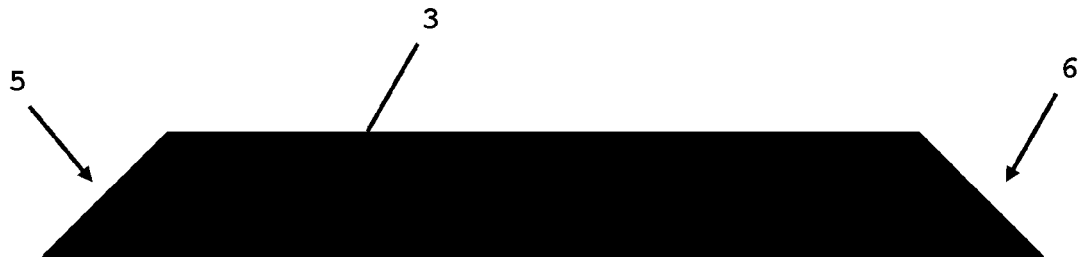
FIG. 2 represents schematically a first embodiment of the panels used in the substructure unit according to the invention.

The two opposite ends 5 and 6 of the panels 3 comprise bevelled cuts (FIGS. 2 to 4), the cuts being in opposite directions. Therefore the panels 3 comprise a side longer than the other. Preferably, the ends 5 and 6 are cut with an angle of around 45 degrees.

Figure 3:
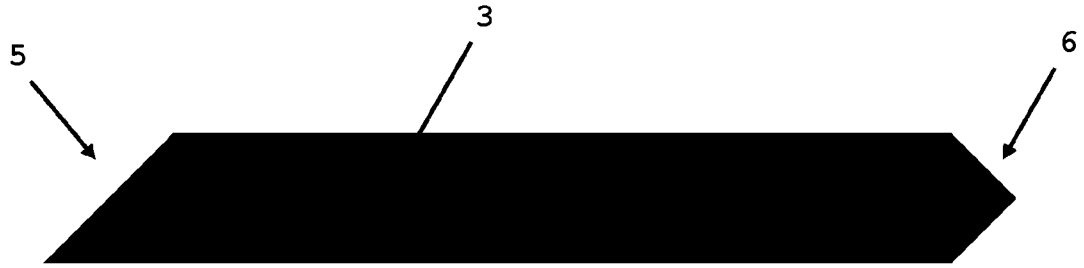
FIG. 3 represents schematically a second embodiment of the panels used in the substructure unit according to the invention.
Figure 4:
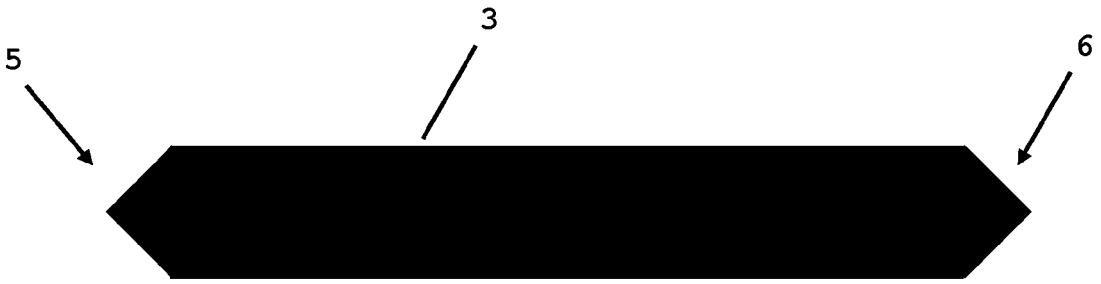
FIG. 4 represents schematically a third embodiment of the panels used in the substructure unit according to the invention.

Some panels 3 comprise an end 5 or end 6 comprising an arrow cut (FIG. 3). Some other panels comprise identical ends 5 and 6 having each an arrow cut (FIG. 4).

Figure 5:
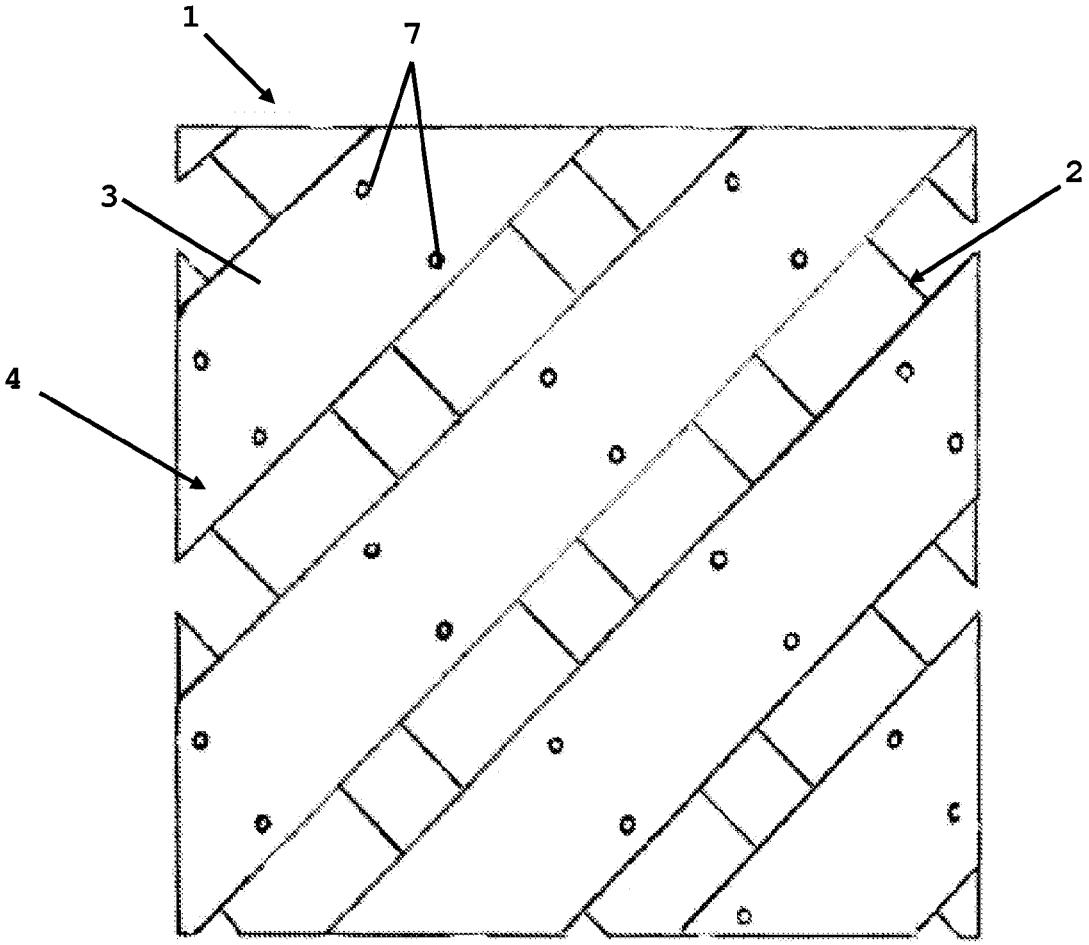
FIG. 5 represents schematically a closer view of the substructure unit according to the invention.

The two series 2 and 4 of parallel panels 3, are fastened by at least one screw 7, preferably two screws, more preferably made of wood. The screw are provided at each juxtaposed or overlapping portion between two panels 3 of the first and second panels series 2 and 4 (FIG. 5). The use of screws presents the advantage to enhance the stability of the substructure unit 1 in comparison to nails generally used to joint a panel over another one.

By using such fastening means, the panels 3 cannot become loose during shipping and installation of the substructure unit 1 on the surface to cover. Indeed, screwing each panels 3 is very secure and the substructure unit 1 can be shipped, handled, and installed without compromising the integrity of the substructure unit 1 and thus of the flooring system. Moreover, the double screwing at each overlapping portion of panels 3 offers a stronger and more secure unit and system.

Preferably, the space between the parallel panels is identical within a series of panels 3 and may also be identical between panels 3 of the two series 2 and 4. In a preferred embodiment, the space between the panels 3 is comprised between two inches (5 cm) and three inches (7.62 cm), preferably the space is of two inches (5 cm).

In a preferred embodiment, the space between two panels 3 of the first series 2 (lower layer) is higher than the one of the second series 4 (upper layer). For example, the space of the second series 4 is of around two inches (5 cm) and the one of the first series 2 is of around 6 inches (15.24 cm).

The substructure unit 1 further comprises coupling means to connect at least two substructure units 1 together.

Figure 6:
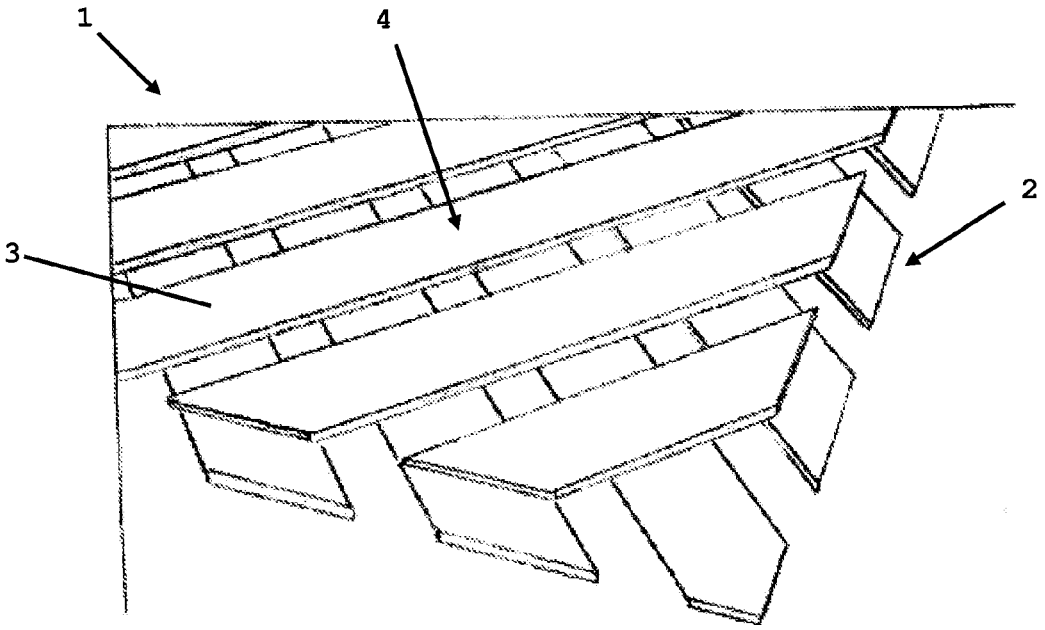
FIG. 6 represents a perspective view of the substructure unit according to the invention.
Figure 8:
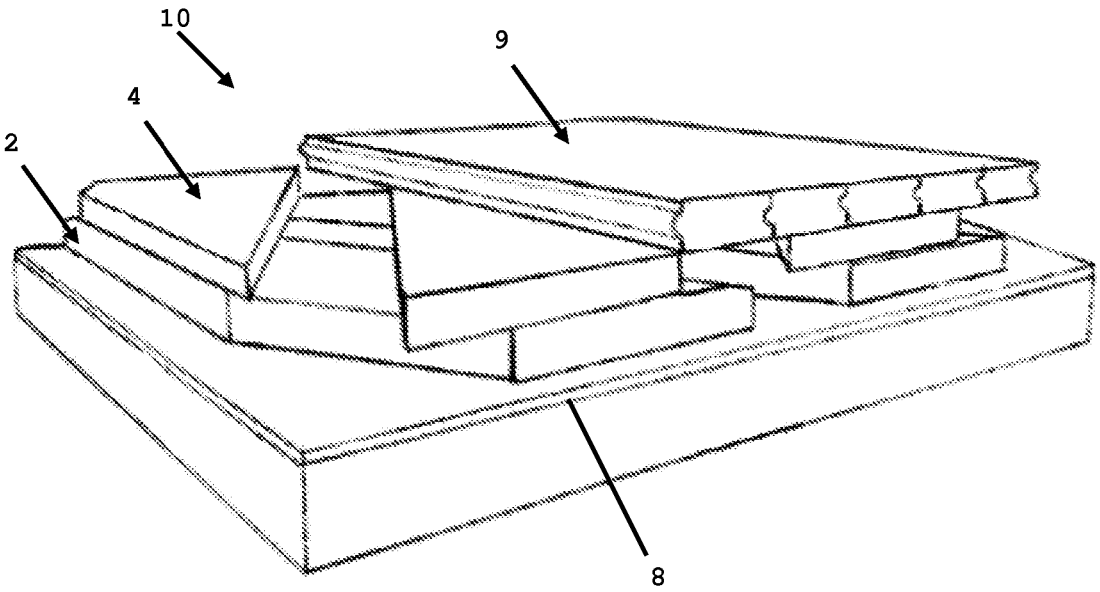
FIG. 8 represents a perspective view of the flooring system according to the invention.

In a preferred embodiment, the coupling means are formed by the opposite ends 5 and 6 of the panels 3 extending outwardly from at least one edge, preferably from two opposite edges, more preferably from three edges, even more preferably from four edges, of the substructure unit 1. To get such coupling means, the panels 3 of the first series 2 are shifted from the panels 3 of the second series 4 (FIGS. 1, 6 and 8). The panels 3 are arranged so that the bevelled cut ends 5 or 6 of a series of panels 3 are oriented in the same direction at one edge of the substructure unit 1. The panel 3 of the first series 2 or second series 4 shared by two adjacent edges of the substructure unit 1 comprises at least one end 6 having an arrow cut (FIG. 3).

The coupling means of a first substructure unit 1 cooperate with the interconnecting means of a second adjacent substructure unit 1.

Figure 7:
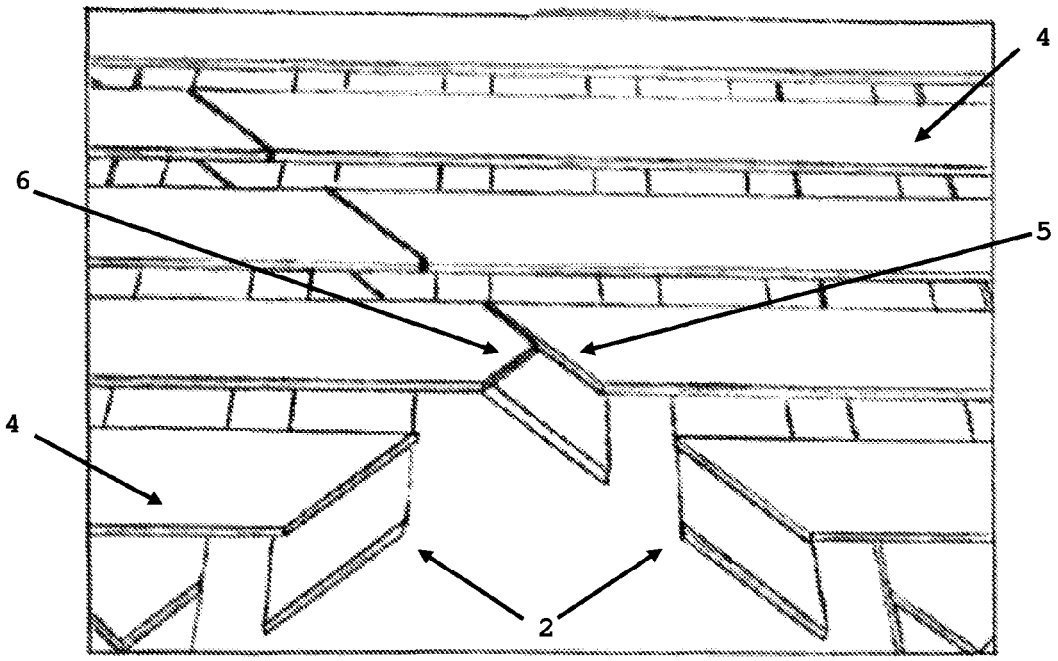
FIG. 7 represents a view of the interconnection of two adjacent substructure units.

In the preferred embodiment mentioned, the bevelled cut ends 5 and 6 of the panels 3 of the first series 2 cooperate with the bevelled cut ends 5 and 6 of the second series 4 of the adjacent substructure unit 1 to form a finger joint junction (FIG. 7). The ends 5 or 6 of the panels 3 of one substructure unit 1 overlap the ends 5 or 6 of the panels 3 of the second offering thus a more dimensionally stable substructure. Furthermore, by using such a finger joint junction between several substructure units 1, it appears that the flooring system (10) presents the same dimensional stability over its entire surface.

Preferably, the finger joint junction between two substructure unit 1 has a construction tolerance of no more than 0.25 inch (0.635 cm) variance.

The substructure unit 1 has any suitable shape, as for example a square, a rectangular, or a polygonal shape. In the embodiments wherein the substructure unit 1 has a square or a rectangular shape, the longer panels 3 are arranged in the centre of the substructure unit 1 and the shorter at the edges of the substructure unit 1.

The substructure unit 1 has any suitable dimension. Preferably, its length is comprised between 48 inches (1.22 m) and 96 inches (2.44 m).

In a preferred embodiment the substructure unit 1 is eight feet (2.44 m)long and four feet (1.22 m) wide.

The unit 1 may further comprise resilient means.

Preferably, the resilient means are provided under the panels 3 of the first series 2 and are intended to contact the surface to cover.

The resilient means comprise preferably a cushioning foam having any suitable grade, hardness, thickness, width, and is made of any suitable material, such as for example urethane.

The substructure unit 1 according to the invention is preferably a prefabricated unit, produced in a remote location away from the installation site of the flooring system 10. The substructure unit 1 presents thus the advantage of being pre-engineered prior the installation of the flooring system 10. The flooring system 10 is thus easier to install, with a significant reduction in time requirement to perform the installation. Furthermore, it gives more assurance that the substructure unit 1, and thus the flooring system, fits the requirements of the installation site.

On the location of installation of the flooring system 10, one substructure unit 1 is laid on the surface to cover or on a barrier layer 8.

The barrier layer 8, if any, is any suitable layer having vapour barrier properties. Preferably, the barrier layer 8 is a 0.25 inch (0.635 cm) or 0.5 inch (1.27 cm) high density premium foam or a 0.5 inch (1.27 cm) 6 pounds true density rebonded urethane foam.

The barrier layer 8 thickness, density, and construction are modifiable based on the needs of the facility receiving said flooring system 10.

The first substructure unit 1 is then connected to at least another adjacent substructure unit 1 using the coupling means of each substructure unit 1 which are complementary one with the other.

The plurality of interconnected substructure units 1 forms a flat, continuous, and floating structure.

Figure 9:
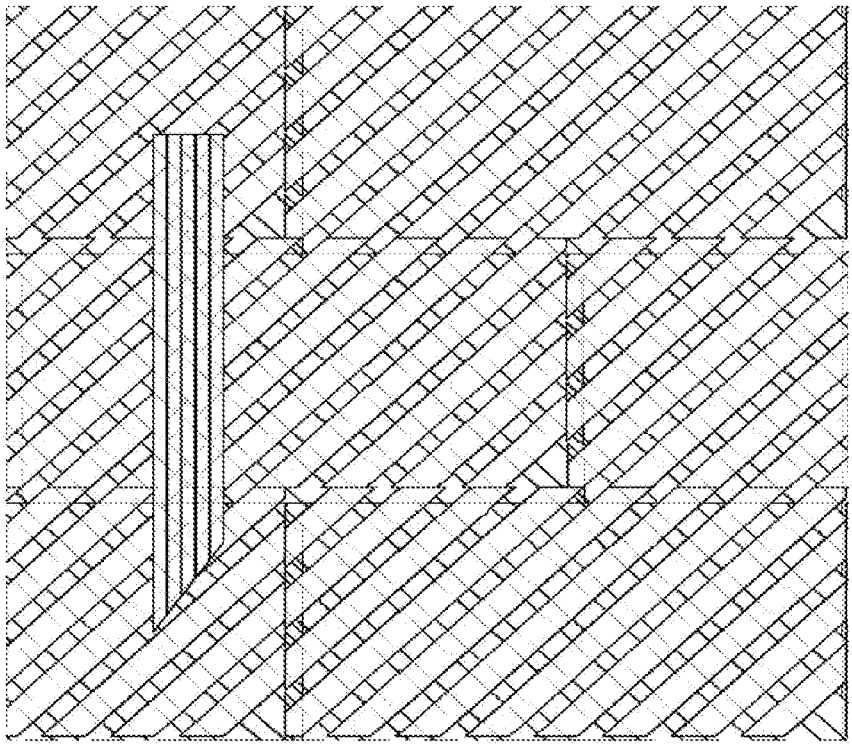
FIG. 9 represents schematically an upper view of the flooring system according to the invention, which comprises a plurality of substructure units and an upper flooring comprising several panels.

The flooring system according to the invention comprises at least one substructure unit 1, preferably a plurality of interconnected substructure units 1 and an upper flooring 9 (FIGS. 8 and 9).

The use of the substructure unit 1 gives to the flooring system 10 airflow and resiliency.

The upper flooring 9 is any suitable upper flooring. Preferably it comprises flooring elements of the type usually termed strips, planks or laths made of wood (FIG. 8). The laths are laid onto the at least one substructure unit 1, aligned in a parallel pattern, and arranged parallel to one of the axis of the quadrilateral formed by the lattice of the substructure unit 1 (FIG. 9).

In a preferred embodiment, the upper flooring comprises laths having a random length, a width of 1.5 inches (3.81 cm) or 2.25 inches (5.715 cm) and a thickness comprised between 25/32 inches (1.98 cm) and 33/32 inches (2.62 cm).

The upper flooring elements are fastened together using any suitable means, for example by means of a tongue and a groove, one side of each laths having a groove, and the other side having a tongue. The upper flooring elements can also be glued together.

The upper flooring elements are preferably fastened to the at least one substructure unit 1 by any suitable means, preferably by 1.5 inches (3.81 cm) to two inches (5.08 cm) cleats or coated staples nailed every twelve inches (30.48 cm).

The upper flooring 9 is spaced away from the walls and other vertical abutments of the sports facilities and garnished with a vented base, preferably by a three inches (7.62 cm) per four inches (10.16 cm) vented base made of rubber, wood, or metal, having any suitable form to allow the substructure units to "breath" around the perimeter of the installed floor system.

The substructure units 1 and the flooring system according to the invention are suitable for all sports facilities, in particular for aerobics and fitness facilities.

The method to install the flooring system 10 according the invention comprises the steps of depositing at least one substructure unit 1 according to the invention, on the surface to cover and of depositing at least one flooring element of an upper flooring 9.

Preferably the substructure unit 1 is a prefabricated substructure unit 1 assembled in a remote place from the location of installation of the flooring system 10.

The method may further comprise the step of depositing a barrier layer 8 on the surface to cover before depositing the at least one substructure unit 1.

Figure 10:
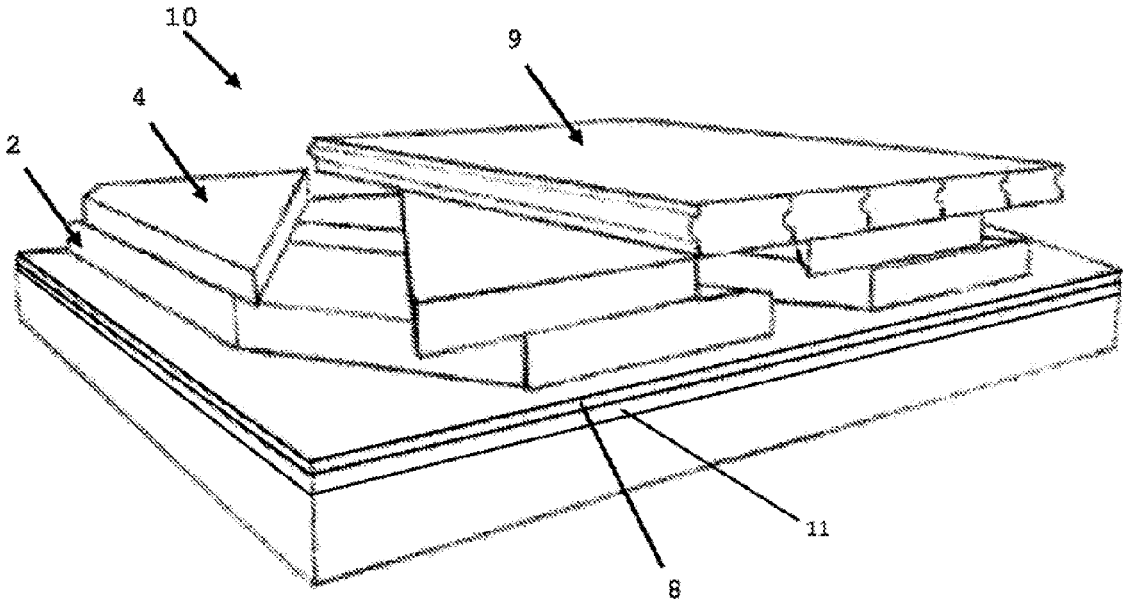
FIG. 10 represents a perspective view of an embodiment of the flooring system according to the invention.

The method may further comprise the step of depositing a force reducing cushioned barrier (11) (FIG. 10) over the surface to cover or over the barrier layer 8 before depositing the at least one substructure unit 1.

The invention claimed is:

1. A prefabricated substructure unit for a sports flooring system, said prefabricated substructure unit not comprising an upper flooring but configured to have an upper flooring laid thereon after installation of said prefabricated substructure unit on an installation site, said prefabricated substructure unit having a first, second, third and fourth edge, wherein said first edge is located opposite said third edge, and said second edge is located opposite said fourth edge, said substructure unit comprising a first series of panels arranged in parallel and being fixed under a second series of panels arranged in parallel, said first series and second series of panels being arranged in a criss-cross manner to form a diagonal lattice to be posed flat on a surface to be covered with said substructure unit, said panels of said first and second series having beveled cut ends extending outwardly from said lattice, said beveled cut ends from said panels of said first and second series mutually cooperating along said first, second, third and fourth edge to form coupling means to interconnect at least two substructure units, wherein at said first and said second edge, said beveled cut ends from said panels of said second series project beyond said beveled cut ends from said panels of said first series, to form a coupling means of a first type;

at said third and fourth edge, said beveled cut ends from said panels of said first series project beyond said beveled cut ends from said panels of said second series, to form a coupling means of a second type; and said coupling means of said first type are complementary to said coupling means of said second type, so that when said coupling means of the first type of a first substructure unit is interconnected with said coupling means of the second type of a second substructure unit, said beveled cut ends from said panels of said second series of said coupling means of said first type overlap the beveled cut ends from said panels of said first series of said coupling means of said second type wherein the panels of the first series are fastened to the panels of the second series by a double screwing at each overlapping portion of panels of the first series with the panels of the second series.

2. The substructure unit according to claim 1, wherein the panels of the first series of panels are arranged at an angle of about 90 degrees in respect to the panels of said second series of panels.

3. The substructure unit according to claim 1, wherein the beveled cut ends of the panels have an angle of about 45 degrees.

4. The substructure unit according to claim 1, wherein the panels are made of wood.

5. The substructure unit according to claim 1, wherein the space between two panels of the first series is bigger than the space between two panels of the second series.

6. The substructure unit according to claim 1, further comprising resilient means provided under the panels of the first series of panels.

7. A sports flooring system comprising at least a first and a second substructure unit according to claim 1, wherein said coupling means of said first type of said first substructure unit cooperate with said coupling means of said second type of said substructure unit to interconnect both substructure units, so that beveled cut ends from said panels of second series overlap beveled cut ends from said panels of said first series.

8. The flooring system according to claim 7, comprising an upper flooring including flooring elements laid on the interconnected substructure units, fastened together in a parallel pattern and arranged parallel to one of the edges of the interconnected substructure units.

9. A method to install a flooring system, said method comprising the steps of:

providing at least two substructure units according to claim 1, depositing on the surface to cover at least one barrier layer having vapour barrier properties, depositing on said barrier layer said at least two substructure units, -interconnecting said at least two substructure units along two adjacent edges, on edge having coupling means of said first type and the other edge having coupling means of said second type, so that along said adjacent edges, beveled cut ends from said panels of said second series of one substructure unit overlap beveled cut ends from said panels of said first series of the other substructure unit, depositing at least one flooring element of an upper flooring on the interconnected substructure units.

10. The method according to claim 9, wherein the prefabricated substructure units are assembled in a remote place from the location of installation of the flooring system.

11. The method according to claim 10, further comprising the step of assembling resilient means under the panels of the first series of panels of the substructure unit.

12. The method according to claim 9, further comprising the step of depositing a force reducing cushioned barrier over the surface to cover or over the barrier layer before depositing the at least one substructure unit.

13. The substructure unit according to claim 1, wherein said beveled cut ends of said first and second series of panels are oriented substantially perpendicular to said surface to be covered.

14. The substructure unit of claim 1, wherein:

each panel extends in a lengthwise direction between the beveled cut ends;

each panel has a first surface and a second surface opposite to and parallel to the first surface, the first and second surfaces being arranged parallel to the lengthwise direction;

each panel has first and second sides extending between the first and second surfaces and extending along the lengthwise direction between the beveled cut ends, each beveled cut end including a first planar surface that extends entirely between the first and second surfaces, the first planar surface being oblique to the lengthwise direction and parallel to an edge of the substructure unit;

the first surfaces of the panels of the first series of panels facing and being parallel to the second surfaces of the of the panels of the second series of panels.

15. The substructure unit of claim 14, wherein:

a first plurality of adjacent beveled cut ends of the first series of panels align and define a first edge of the first series of panels that is parallel to the edge of the substructure unit, the first edge of the first series of panels being oblique to the lengthwise direction;

a first plurality of adjacent beveled cut ends of the second series of panels align and define a first edge of the second series of panels that is parallel to the edge of the substructure and parallel to the first edge of the first series of panels;

the first edge of the first series of panels being transversely offset from the first edge of the second series of panels to form the coupling means to interconnect at least two substructure units.

16. The substructure unit of claim 15, wherein:

a second plurality of adjacent beveled cut ends of the first series of panels defines a second edge of the first series of panels that is non-parallel to the first edge of the first series of panels, the second edge of the first series of panels being oblique to the lengthwise direction;

a second plurality of adjacent beveled cut ends of the second series of panels defines a second edge of the second series of panels that is parallel to the second edge of the first series of panels;

the second edge of the first series of panels being transversely offset from the second edge of the second series of panels to form part of the coupling means to interconnect at least two substructure units.

17. The substructure unit according to claim 1, wherein said beveled cut edges of said first series of panels form an edge of a first rectangular contour, said beveled cut edges of said second series of panels form an edge of second rectangular contour; said rectangular contours having the same orientation but being diagonally offset from each other in such a way that said beveled cut edges of the first and second rectangular contours of said first and second series of panels form coupling means for interconnecting with complementary coupling means of another substructure unit.

18. The substructure unit according to claim 1, wherein the coupling means of said second type is a protruding socle and wherein the coupling means of said first type is an overhang.

19. A prefabricated substructure unit for a sports flooring system, said prefabricated substructure unit not comprising an upper flooring but configured to have an upper flooring laid thereon after installation of said prefabricated substructure unit on an installation site, said substructure unit having four edges and comprising a lattice to be posed flat on a surface to be covered with said sports flooring, said lattice including a first series of panels arranged in parallel to one another in a first plane that is parallel to said surface to be covered and a second series of panels arranged in parallel to one another in a second plane that is parallel to said surface to be covered, said first and second series of panels being arranged in a criss-cross manner, said panels of said first series having at the ends thereof bevel-cut end surfaces aligned along said four edges of said unit in said first plane, so as to define a first rectangular contour, said panels of said second series having at the ends thereof bevel-cut end surfaces aligned along said four edges of said unit in said second plane, so as to define a second rectangular contour, said first and second rectangular contours having the same orientation but being diagonally offset from each other in such a way that the ends of said first and second series of panels form, at each edge of said substructure unit, coupling means for interconnecting with complementary coupling means of another substructure unit, said beveled cut ends of said first and second series of panels being oriented in the same direction at each edge of the substructure unit, in parallel to said edge wherein the panels of the first series are fastened to the panels of the second series by a double screwing at each overlapping portion of panels of the first series with the panels of the second series.

20. The substructure unit according to claim 19, wherein the panels are made of wood.

21. The substructure unit according to claim 19, wherein a vector defining the diagonal offset of the first series of panels from the second series of panels is non-parallel and non-perpendicular to the sides of the first and second rectangular contours.

22. The substructure unit according to claim 19, wherein:

the first series of panels extend at a non-parallel and non-perpendicular orientation to sides of the first and second rectangular contours;

the second series of panels extend at a non-parallel and non-perpendicular orientation to sides of the first and second rectangular contours.

23. The substructure unit according to claim 19, wherein each end of the first series of panels forms part of the first rectangular contour and each end of the second series of panels forms part of the second rectangular contour.

24. The substructure unit according to claim 19, wherein:

said prefabricated substructure unit has a first, second, third and fourth edge, wherein said first edge is located opposite said third edge, and said second edge is located opposite said fourth edge;

at said first and said second edge, said beveled cut ends from said panels of said second series project over said beveled cut ends from said panels of said first series, to form coupling means of a first type;

at said third and fourth edge, said beveled cut ends from said panels of said first series project over said beveled cut ends from said panels of said second series, to form coupling means of a second type; and said coupling means of said first type are capable of cooperating with said coupling means of said second type, when interconnecting two of such prefabricated substructure units.

25. A prefabricated substructure unit for a sports flooring system, said prefabricated substructure unit having a first, second, third and fourth edge, wherein said first edge is located opposite said third edge, and said second edge is located opposite said fourth edge, said substructure unit consisting of a first series of panels arranged in parallel and being fixed under a second series of panels arranged in parallel, said first series and second series of panels being arranged in a criss-cross manner to form a diagonal lattice to be posed flat on a surface to be covered with said substructure unit, said panels of said first and second series having beveled cut ends extending outwardly from said lattice, said beveled cut ends from said panels of said first and second series mutually cooperating along said first, second, third and fourth edge to form coupling means to interconnect at least two substructure units, wherein at said first and said second edge, said beveled cut ends from said panels of said second series project beyond said beveled cut ends from said panels of said first series, to form a coupling means of a first type;

at said third and fourth edge, said beveled cut ends from said panels of said first series project beyond said beveled cut ends from said panels of said second series, to form a coupling means of a second type; and said coupling means of said first type are complementary to said coupling means of said second type, so that when said coupling means of the first type of a first substructure unit is interconnected with said coupling means of the second type of a second substructure unit, said beveled cut ends from said panels of said second series of said coupling means of said first type overlap the beveled cut ends from said panels of said first series of said coupling means of said second type.

* * * * *